United States Patent [19]

Gustavsson et al.

[11] Patent Number: 5,025,732

[45] Date of Patent: Jun. 25, 1991

[54] AMMUNITION UNITS

[75] Inventors: Lennart Gustavsson; Ewa Karlsson; Jan Reinholdsson, all of Karlskoga, Sweden

[73] Assignee: Aktiebolaget Bofors, Karlskoga, Sweden

[21] Appl. No.: 417,520

[22] Filed: Oct. 5, 1989

[30] Foreign Application Priority Data

Oct. 6, 1988 [SE] Sweden ..... 8803542

[51] Int. Cl.[5] ..... F42B 14/06

[52] U.S. Cl. ..... 102/521

[58] Field of Search ..... 102/520–523

[56] References Cited

U.S. PATENT DOCUMENTS

| | | | |
|---|---|---|---|
| 3,446,147 | 5/1969 | Engel . | |
| 4,719,860 | 1/1988 | Ruffle . | |
| 4,757,766 | 7/1988 | Ruffle | 102/521 |
| 4,911,080 | 3/1990 | Leeker et al. | 102/520 |

FOREIGN PATENT DOCUMENTS

| | | | |
|---|---|---|---|
| 2401399 | 3/1979 | France . | |
| 133675 | 11/1951 | Sweden | 102/522 |

*Primary Examiner*—Harold J. Tudor

*Attorney, Agent, or Firm*—Pollock, Vande Sande & Priddy

[57] ABSTRACT

An apparatus is provided for the loading and automatic firing in a weapon of an ammunition unit provided with a sabot without consequential deterioration of the ballistics of the ammunition unit. The apparatus comprises a unit consisting of a number of prismatic or cuneiform elements which together form a rotationally symmetrical body with an external surface. This surface is truncated or curved and flares rearwardly from its leading portion. The apparatus also comprises an enclosing device for enclosing these elements at the trailing portions of the body, and unifying the elements on loading of the ammunition unit into the barrel of the weapon. The enclosing device also encloses the leading portions of the sabot. This device is arranged to burst on movement of the ammunition unit in the barrel. The elements will namely execute flip movements about their trailing portions which are defined by the inner wall of the barrel and entail that rotationally symmetrical body is splayed forwardly, which facilitates parting of the elements with the aid of aerodynamic forces on departure of the unit from the barrel.

8 Claims, 2 Drawing Sheets

AMMUNITION UNITS

TECHNICAL FIELD

The present invention relates to an apparatus which makes possible the loading and automatic firing in a weapon of an ammunition unit provided with a sabot, without consequential deterioration in the ballistic properties (inner and outer ballistics) of the ammunition unit.

BACKGROUND ART

It is previously known in this art to employ sabots on so-called rod or needle rounds. There are different types of sabots in existence and so-called reel sabots may be mentioned by way of example.

In the type of ammunition unit under consideration here, problems may arise in feeding the ammunition unit into the weapon without some leading edge, for instance on the sabot, becoming jammed.

SUMMARY OF THE INVENTION

The object of the present invention is to propose an apparatus which obviates this and other drawbacks inherent in prior art apparatus. The present invention is characterized in that, among other things, it includes a unit which consists of a number of prismatic or cuneiform elements which together make up a rotationally symmetrical body with an external surface which is conical or curved so that it flares from its leading portion rearwardly towards its trailing portion. The apparatus also comprises a device enclosing these elements at the trailing portion of the body and holding the elements together during loading of the ammunition unit and its movement in the barrel of the weapon.

The enclosing device is arranged to burst preferably during its movement in the barrel, in which immense stress forces arise during discharge or launching of the ammunition unit. When this device bursts, the above-mentioned elements execute flip movements about their trailing portions and, by such means, the rotationally symmetrical body is splayed at its leading area and meets the aerodynamic forces in the splayed condition on exit of the unit from the barrel.

In one embodiment, the enclosing device consists of an annular device provided with slots which extend in the main longitudinal direction of the ammunition unit and being of a length which is slightly less than the length of the annular device itself. The annular device displays an externally coned surface which forms a common coned or curved surface with the outer surface of the body proper.

At each respective slot, there is disposed a small portion of residual material which bursts during the above-mentioned movement in the barrel of the weapon. In one embodiment, the annular device is designed with a portion which is coned in the longitudinal section of the device and merges into a straight portion, each respective slot extending, in such instance, along the entire coned portion and into the straight portion. In a further embodiment, each respective slot extends into the straight portion for more than half of its length (extending in the longitudinal direction of the ammunition unit). The termination of the slot in the straight portion is, in this instance, registered with a recess which extends in from the trailing edge of the straight portion. Furthermore, each respective slot and recess may be designed with an acute-angled bottom and display a bottom angle of, for instance, 90°.

The coned or curved surface of the body may rearwardly merge into a surface which is straight in the longitudinal section of the body and is registrable with a straight internal surface on the enclosing device. In its turn, the straight surface of the body merges rearwardly in a further coned surface which is registered with an internally coned surface on the enclosing device. This further coned surface of the body subsequently merges in an arcuate surface of decreasing diametric size, from which surface a boss-like portion extends. By means of the boss-like portion, the body may be abutted against and journalled in leading portions of the sabot. In this embodiment, the enclosing device may display a rear, straight inner surface by means of which the enclosing device is journalled on the sabot, at the forward portion thereof. By such means, a space will be formed between the trailing portion of the enclosing device and the boss-like portion on the body. The enclosing device and the boss-like portion house, in this space, a forwardly projecting portion or portions of the sabot.

The body is designed with a longitudinal central recess, by means of which the body surrounds a neck-shaped portion on the ammunition unit. In such instance, the diameter of the leading portion of the body is dimensioned to be such that it corresponds to that of the neck-shaped portion at its forward regions and such that there is a transitional region from the nose, of the ammunition unit which flares rearwardly to the full caliber of the sabot/ammunition unit. The slots on the enclosing device are preferably 2–4 in number, and most appropriately 3 in number.

The arrangement proposed in the foregoing makes possible a guiding cap which substantially facilitates loading of the pertinent ammunition unit (rod or needle round) into the weapon. The guiding arrangement is designed so as to retain its cohesion on ramming, but to splay forwardly when the projectile moves in the barrel. The problem inherent herein is solved in that the enclosing or annular device is provided, for instance, with three nicks specifically adapted for this function. By such means, the ramming operation may be catered for, as well as a satisfactory separation function for the elements and the parts of the sabot.

BRIEF DESCRIPTION OF THE ACCOMPANYING DRAWINGS

The nature of the present invention and its aspects will be more readily understood from the following brief description of the accompanying Drawings, and discussion relating thereto of one preferred embodiment of an apparatus displaying the characterizing features significative of the present invention.

DESCRIPTION OF PREFERRED EMBODIMENT

Figure 1:
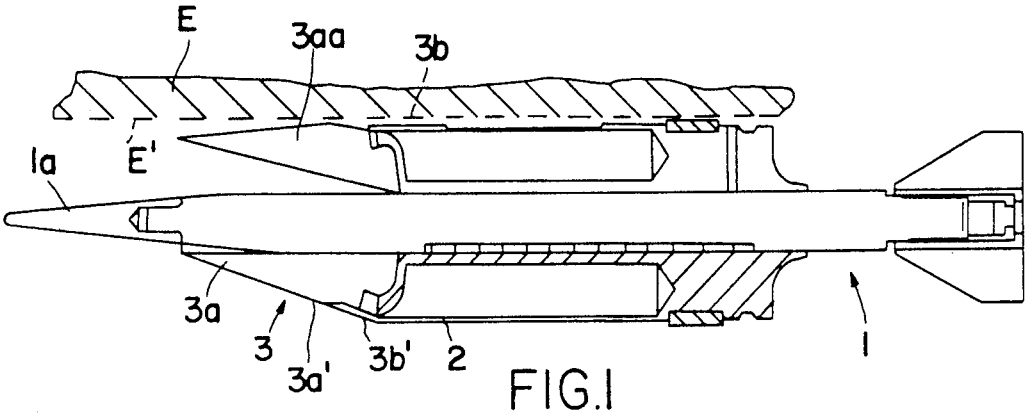
FIG. 1 is a longitudinal section showing an ammunition unit of the type generally known as a rod or needle round, with sabot and guiding cap, cuneiform elements included in the latter being shown in two different operational positions.

Referring to the Drawings, an ammunition unit of the rod or needle type is indicated by reference numeral 1 in FIG. 1. Such ammunition unit is previously known and will not, therefore, be described in greater detail here. The ammunition unit is of the type which carries a sabot 2 consisting of a number of parts which are parted on the exit of the ammunition unit from the weapon, this being represented by a barrel portion E. The construciton and design of the sabot are also previously known and will not, therefore, be described in greater detail here. At the leading portion of the sabot, there is disposed a guiding cap 3 according to the present invention. The guiding cap fundamentally consists of two parts, of which the first comprises a body 3*a*, 3*aa* composed of a number of prismatic or cuneiform elements, and an annular device 3*b* unifying these elements. The elements may assume two different functional states, of which an initial state is represented by reference numeral 3*a* and an actuation state is represented by reference numeral 3*aa*. In the initial state, the body 3*a*, 3*aa* and the annular device display an externally composed, rotationally symmetric surface 3*a*', 3*b*' which flares, from the leading portion of the body rearwardly and which may be straight or curved. In the actuation state, each respective element has turned about its trailing portion so that the body 3 is splayed forwardly. The turning movement for each respective element is defined and limited by the inner surface E' of the barrel, by cooperation with the surface and an outer surface on each respective element. The tip of the ammunition unit is indicated by reference numeral 1*a* and thence the outside of the tip merges, through the intermediary of the outer surface 3*a*', 3*b*' of the guiding unit, to the full caliber of the ammunition unit/sabot at the above-mentioned initial state.

Figure 2:
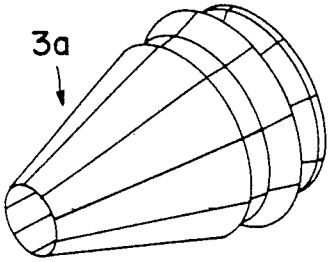
FIG. 2 is a perspective view of a rotationally symmetric body composed of prismatic or cuneiform elements and included in the ammunition unit according to FIG. 1.
Figure 3:
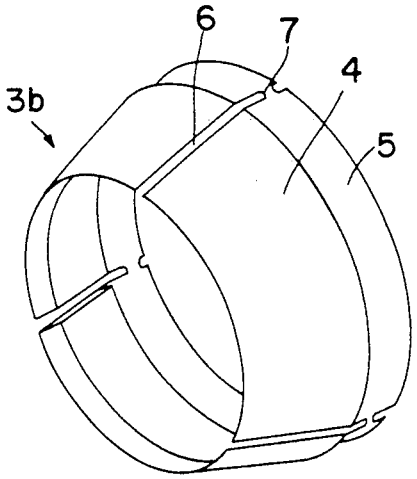
FIG. 3 is a perspective view of a unifying device for the body according to FIG. 2.
Figure 4:
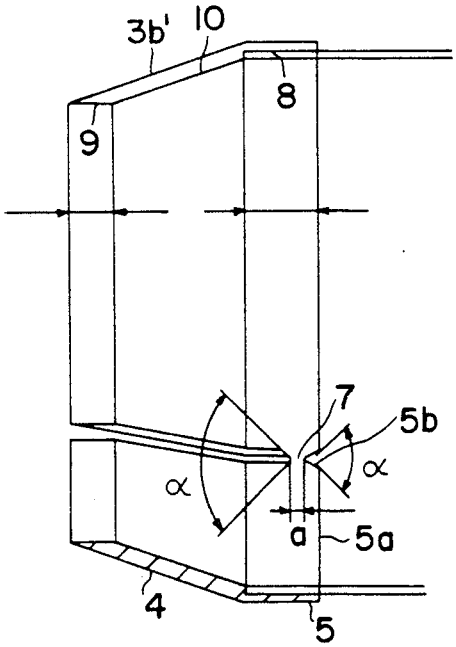
FIG. 4 is a side elevation of the unifying device according to FIG. 3.
Figure 5:
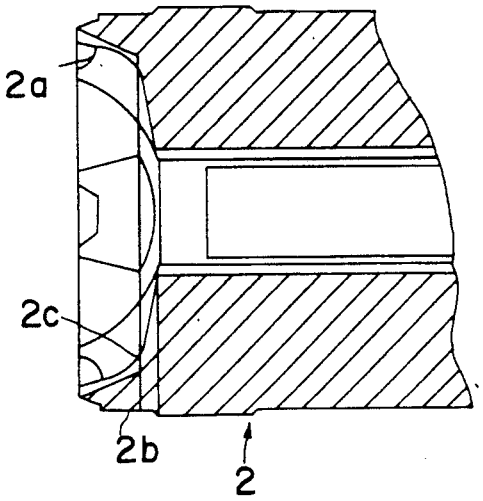
FIG. 5 shows, in longitudinal section, parts of a sabot included in FIG. 1.

The construciton (initial state) of the body 3*a* is apparent from FIG. 2. In the present case, the number of elements has been set at 9. However, this number may be selected, for instance, from between 6 and 12 elements. The enclosing annular device 3*b* in accordance with FIG. 1 is shown in FIGS. 3 and 4. The annular device is rotationally symmetric and displays a truncated portion 4 and a straight portion 5. The device is provided with longitudinal slots 6 uniformly distributed about its periphery. In the present case, the number of slots is 3, but may, for example, be selected from between 2 and 4 slots. Each respective slot extends throughout the entire length of the conical portion and into the straight portion 5. In one embodiment, the slot extends in more than half of the length of the straight portion. A recess 5*b* is disposed in register with the termination of each respective slot from the trailing edge 5*a* of the straight portion. Each respective slot and recess is provided with an acute angled bottom, with a bottom angle $\alpha$ of, for instance, 90°. Each respective slot and recess leaves a residual portion 7 with material which is arranged to burst upon departure of the ammunition unit from the barrel, or preferably already inside the barrel. This residual material is of a length a which lies within the order of between 2 and 6 mm and is preferably about 4 mm. At the straight portion, the wall thickness of the annular device is 1–2 mm, and at the truncated portion 2–4 mm. The straight portion is provided with an inner recess 8 with which the device 3*b* surrounds and encloses leading portions of the sabot 2 according to FIG. 1. The device 3*b* is further designed with a straight inner surface 9 at the leading portion of the device. Moreover, the device 3*b* displays a truncated inner surface 10. FIG. 5 illustrates the leading portions of the sabot, it being apparent from this Figure that the sabot includes forwardly projecting portions 2*a*, a straight journalling surface 2*b* for the enclosing device 3*b* and a curved trailing surface 2*c* which is provided to journal the boss-like or sphere-shaped trailing surface of the body 3*a*.

Figure 6:
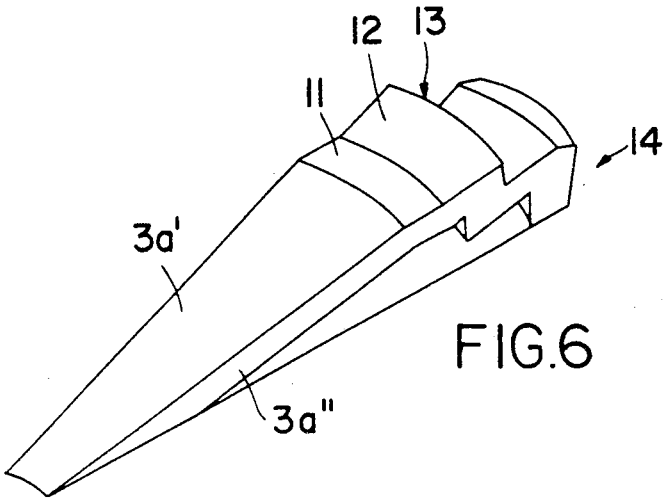
FIG. 6 is a perspective view of a prismatic or cuneiform element in the body according to FIG. 2.

FIG. 6 shows one element 3*a*'' in greater detail. The truncated surface 3*a*' merges in a surface 11 which is straight in the side elevation. In its turn, this surface merges in a further surface 12 which is truncated in side elevation and which flares rearwardly. Finally, the truncated surface 12 merges in a surface 13 which is arcuate or straight in side elevation and which displays a rearwardly tapering diameter dimension. A portion 14 departs from this latter surface 13 and, together with the portions of the other elements, forms a boss-shaped trailing journalling portion for the rotationally symmetrical body.

Figure 7:
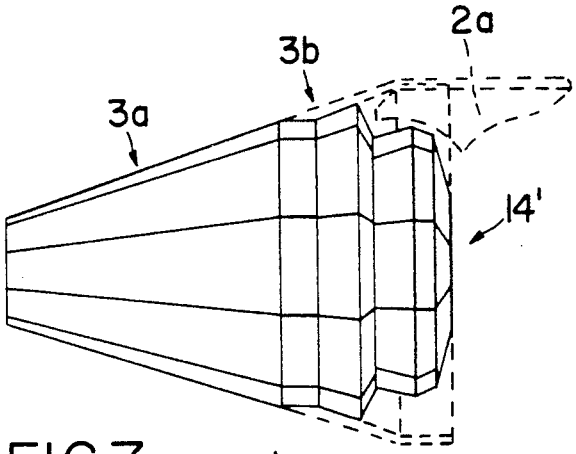
FIG. 7 is a cross section showing parts of the body, the enclosing device and the sabot in the composed state.

In FIG. 7, the device 3*b* has been fitted on the body elements 3*a*. In the composite position, the inner surface 9 (see FIG. 4) of the device 3*b* is in register with the surface 11 (see FIG. 6) on 3*a* and the inner surface 10 on the device 3*b* is in register with the truncated outer surface 12 on the body 3*a*. At the trailing portions where the surface 13 on the body merges in the boss-shaped portion 14', a space is formed between the body 3*a* and the device 3*b*. The forwardly projecting portions 2*a* (see FIG. 5) project into this space. Furthermore, the inner surface 8 of the device 3*b* is in register with the journalling surface 2*b* on the leading edge of the sabot. The device 3*b* thus surrounds both the elements in the body 3*a* and the various parts of the sabot.

A guiding cap formed in this manner will, in accordance with the foregoing disclosure, be resistant to ramming forces in the weapon. Through the intermediary of its outer surfaces 3*a*' and 3*b*', the guiding cap is capable of assisting in an efficient and purposeful guiding of the warhead into the weapon. On propulsion in the barrel, the prismatic or cuneiform elements are enabled to execute turning movements in their journals in the enclosing device 3*b* and the leading end of the sabot. However, this movement does not affect the internal ballistic properties. When the unit departs from the muzzle of the weapon, the elements 3*a*' splayed in the leading ends are exposed to aerodynamic forces which strive to splay the elements further in a radial direction. Thereafter, the parts of the sabot are radially parted in a known manner. A combination of the forces thus acting on the body 3*a* and the device 3*b* entails an efficient release function which ensures purposeful spreading of both the prismatic and cuneiform elements and the parts of the sabot. These elements and parts are radially discarded on exit from the muzzle of the weapon.

The present invention should not be considered as restricted to that described above and shown on the Drawings, many modifications being conceivable without departing from the spirit and scope of the appended Claims and inventive concept as herein disclosed.

What we claim and desire to secure by Letters Patent is:

1. An apparatus for facilitating loading of an ammunition unit without deterioration of the ballistics of the ammunition unit, in a weapon provided with a sabot having a leading portion with a forwardly projecting portion, the apparatus comprising:

a two-part guiding cup disposed at the leading portion of the sabot and including a unit made up of a plurality of separable prismatic elements forming a rotationally symmetrical unit in a unified state, and an enclosing member insertable over the first unit for holding the plurality of elements of the unit in the unified state during loading of the ammunition into a barrel of the weapon and for connecting the unit to the sabot;

the unit further defining an external surface which flares from a leading portion rearwardly towards its trailing portion and at the end of the trailing portion including a boss-shaped portion, and the enclosing member defining an external surface which also flares rearwardly at its leading portion and constitutes, when the enclosing member encloses the unit, continuation of the external surface of the unit;

the enclosing member further defining a trailing portion which is adapted to enclose the leading portion of the sabot and wherein a gap is formed between the boss-shaped portion and an inner surface of the enclosing member for receiving the forwardly projecting portion of the sabot which is designed with surfaces complimentary to those of the inner surface and the boss-shaped portion surface and is journalled therebetween;

wherein the enclosing member is provided with means for allowing its bursting due to the pressure arising during the movement of the ammunition unit in the barrel; and whereupon the elements of the unit are adapted to execute flip movements about their trailing portions, which are defined by the inner wall of the barrel, such that the rotationally symmetrical unit is forwardly splayed and separated in the barrel and on departure of the ammunition unit from the muzzle of the barrel, the rotationally symmetrical unit is subjected to the aerodynamic forces in the splayed, separated condition.

2. The apparatus according to claim 1, wherein the enclosing member consists of an annular member and means for allowing bursting include slots in the annular member extending substantially in the longitudinal direction of the ammunition unit, each slot respectively extending along the major longitudinal direction of the annular device; and wherein there is disposed, at each respective slot, a small section with residual material which bursts due to the pressure during movement of the ammunition unit in the barrel.

3. The apparatus according to claim 2, wherein the annular device is provided with a truncated portion which merges into a straight portion; and wherein each respective slot extends along the entire truncated portion and into the straight portion for more than half the length thereof; and wherein the termination of the slot in the straight portion is in register with a recess which extends in from a trailing edge of the straight portion.

4. The apparatus according to claim 3, wherein each respective slot and recess is designed with an acute-angled bottom; and wherein the angle of the bottom is about 90°.

5. The apparatus according to claim 1, wherein a truncated surface of the unit rearwardly merges in a straight surface which is registrable with a straight interior edge surface on the enclosing device; wherein the straight surface of the unit rearwardly merges in a further truncated surface which is in register with an interior surface on the enclosing device; and wherein the further truncated surface of the body merges in a surface of tapering diameter dimensions, which defines the boss-shaped portion for enabling the flip movements of the elements of the unit.

6. The apparatus according to claim 5, wherein the enclosing device includes a trailing straight inner surface by means of which the enclosing device encloses a journalling surface on the forwardly projecting portion of the sabot.

7. The apparatus according to claim 1, wherein the unit is provided with a longitudinal central recess adapted for surrounding a neck-shaped portion on the ammuntion unit; and wherein the diameter of the leading portion of the unit closely coincides with the diameter of the neck-shaped portion such that a transitional portion is formed from a nose portion of the ammunition unit which flares rearwardly to the full caliber of the sabot/ammunition unit.

8. The apparatus according to claim 6, wherein the unit is provided with a longitudianl central recess adapted for surrounding a neck-shaped portion on the ammunition unit; and wherein the diameter of the leading portion of the unit closely coincides with the diameter of the neck-shaped portion such that a transitional portion is formed from the nose portion of the ammunition unit which flares rearwardly to the full caliber of the sabot/ammunition unit.

* * * * *